US006967443B2

(12) United States Patent
Bigio et al.

(10) Patent No.: US 6,967,443 B2
(45) Date of Patent: Nov. 22, 2005

(54) IR-COATED HALOGEN LAMP USING REFLECTIVE END COATS

(75) Inventors: Laurence Bigio, University Heights, OH (US); Rajasingh Israel, Westlake, OH (US); Ashfaqul I. Chowdhury, Mayfield Heights, OH (US); Laszlo Lieszkovszky, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/714,790

(22) Filed: Nov. 14, 2003

(65) Prior Publication Data

US 2004/0104678 A1 Jun. 3, 2004

Related U.S. Application Data

(63) Continuation of application No. 09/603,025, filed on Jun. 6, 2000, now abandoned.

(51) Int. Cl.[7] ..... H01J 61/35
(52) U.S. Cl. ..... 313/635; 313/110; 313/634
(58) Field of Search ..... 313/110–113, 579–582, 313/318, 634, 635, 631

(56) References Cited

U.S. PATENT DOCUMENTS 4,229,066 A 10/1980 Rancourt et al.
4,375,605 A 3/1983 Fontana et al.
4,535,269 A 8/1985 Tschetter et al.
4,710,677 A 12/1987 Halberstadt et al.
4,794,297 A 12/1988 Gaugel et al.
4,942,331 A 7/1990 Bergman et al.
4,949,005 A 8/1990 Parham et al.
5,017,839 A 5/1991 Arlt et al.
5,045,748 A 9/1991 Ahlgren et al.
5,506,471 A 4/1996 Kosmatka et al.
5,587,626 A 12/1996 Parham et al.
5,660,462 A 8/1997 Bockley et al.
5,670,840 A 9/1997 Lanese et al.
5,708,328 A 1/1998 Mathews et al.
6,225,731 B1 5/2001 Auyang
6,239,550 B1 5/2001 Maeda

*Primary Examiner*—Karabi Guharay

*Assistant Examiner*—Sikha Roy

(74) *Attorney, Agent, or Firm*—Fay, Sharpe, Fagan, Minnich & McKee, LLP

(57) ABSTRACT

A halogen infrared lamp (100) having an infrared reflective coating (118) along with a totally reflecting coating (120) on ends of an ellipsoidal portion of the envelope. The totally reflecting coating reflects the infrared radiation escaping at acute angles and directs the infrared radiation towards the filament to increase the temperature of the filament and thus increase the efficacy of the lamp. The totally reflecting coating may also extend to portions of tubular members extending from the ellipsoidal portion of the envelope.

13 Claims, 3 Drawing Sheets

ASAP Predictions:

Visible Region:

IR Region:

IR-COATED HALOGEN LAMP USING REFLECTIVE END COATS

This is a continuation of application Ser. No. 09/603,025, filed Jun. 6, 2004, abandoned.

BACKGROUND OF THE INVENTION

1. Field of the Invention

This invention relates generally to halogen infrared lamps with reflective coatings on the lamp envelope. More particularly, this invention relates to halogen infrared lamps coated with an infrared reflective coating substantially surrounding the entire envelope along with a totally reflecting coating disposed on ends of an ellipsoidal portion of the envelope.

2. Discussion of the Art

Improving the efficiency of lamps is increasingly important due to the rising cost of energy. Infrared reflective filters, a form of interference filters, have been used to improve the energy efficiency of lamps by reflecting infrared radiation towards the filament to heat the filament and thus increase the efficacy of the lamp. Interference filters have also been used to selectively reflect or transmit light radiation from certain portions of the electromagnetic radiation spectrum such as ultraviolet, visible, and infrared radiation. Interference filters have been used to allow a portion of the visible radiation to transmit through the envelope and reflecting the unwanted visible radiation to produce colored light.

A halogen infrared (HIR) lamp uses an infrared (IR) reflective coating on an elliptical surface of a double ended quartz halogen lamp to preferentially reflect IR radiation to a filament. This coating, however, allows some IR radiation to pass since the reflectivity in the IR region is not one hundred percent. Metal halide discharge lamps have used reflective end-coats to improve the efficacy of lamps by heating up the ends where a metal halide pool forms, thereby increasing the vapor pressure of the pool and therefore the efficacy. Moreover, computer modeling has uncovered that in HIR lamps, IR radiation is preferentially lost at particular angles as measured from the radial axis formed along the filament. If an HIR lamp recaptures the IR radiation lost at these particular angles by using an additional reflective end-coating, similar to metal halide discharge lamps, it is believed that the efficacy of the lamp can be improved.

BRIEF SUMMARY OF THE INVENTION

The present invention is directed to a totally reflecting coating placed near the ends of a HIR lamp to reflect visible and IR radiation at low acute angles and large obtuse angles as measured from an axis defined along the filament. The totally reflecting coating reflects visible and IR radiation towards the filament to heat the filament. Due to the fact that more IR radiation is lost at these angles compared to visible light, the net effect is to return more IR radiation to the coil, thereby heating the coil and increasing the efficacy of the lamp.

The light source is comprised of a light transmissive lamp envelope having a filament centrally disposed within the envelope. The envelope described above has an ellipsoidal portion located centrally between two tubular portions disposed on opposite ends of the ellipsoidal portion. An IR reflective coating substantially surrounds the entire ellipsoidal portion of the envelope and a totally reflecting coating is located on ends of the envelope.

A pair of lead wires are connected to opposite ends of the filament. In another embodiment, the light source may have lead wires extending from only one end of the lamp.

One exemplary embodiment of the lamp has an IR reflective filter coating containing alternate layers of materials with different refractive indices. These different refractive indices allow desired radiation through while reflecting the unwanted radiation. The present invention advantageously provides a totally reflecting coating near the ends of the HIR lamp to preferentially reflect the IR radiation that usually would escape and direct it towards the filament.

The totally reflecting coating on both ends of the envelope preferably subtends an angle from approximately 22° to approximately 45° from the filament axis and surrounding the entire envelope.

A primary benefit of the invention resides in the increased efficacy associated with the subject lamp.

Another benefit of the invention relates to the simple manner in which efficacy of the lamp can be improved.

DETAILED DESCRIPTION OF THE INVENTION

Figure 1:
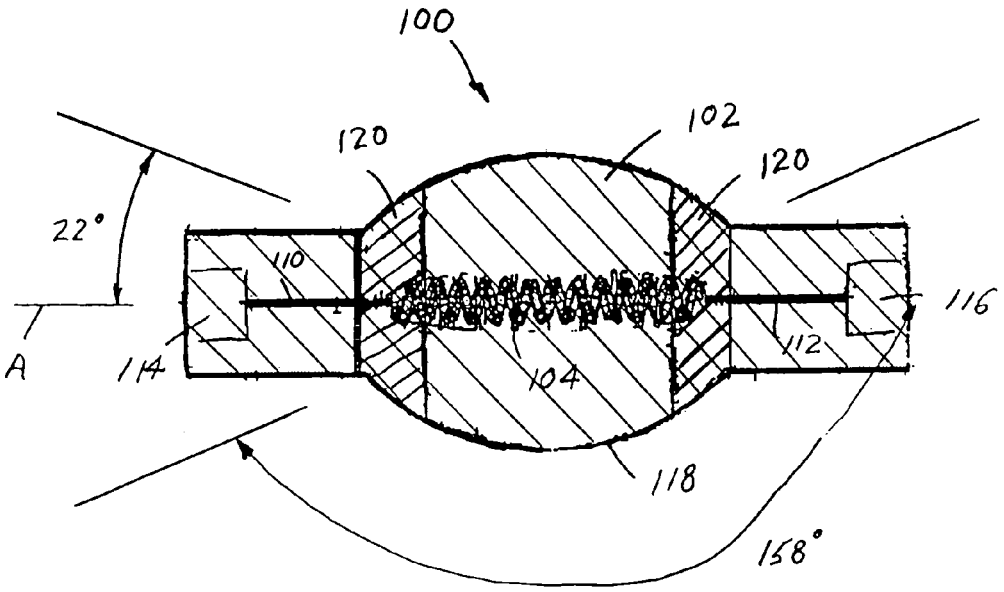
FIG. 1 illustrates an HIR lamp in accordance with one embodiment of the present invention.
Figure 2:
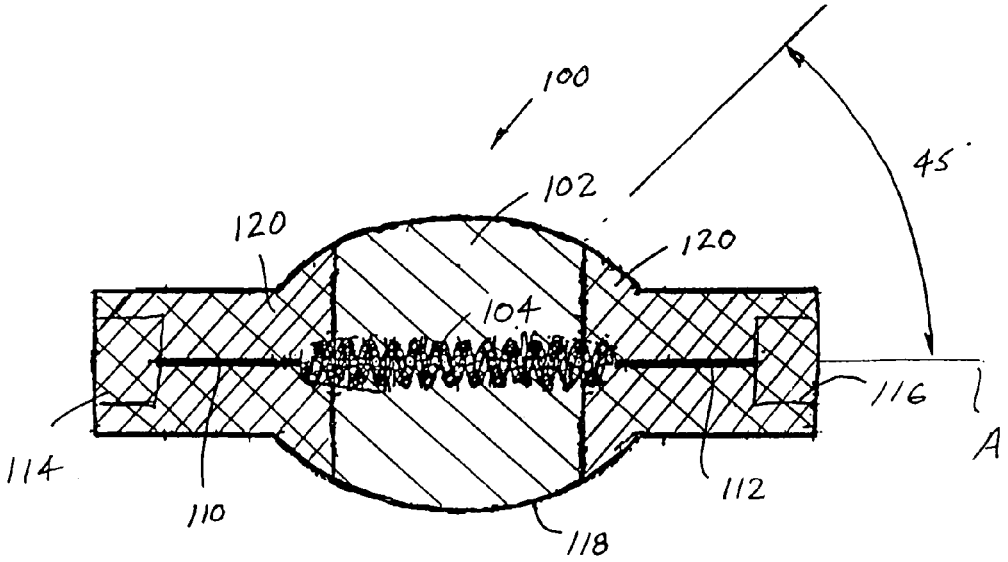
FIG. 2 illustrates an HIR lamp in accordance with a second exemplary embodiment of the present invention.

Exemplary embodiments of the invention are shown in FIGS. 1 and 2 and illustrate a light source or lamp 100 comprising a double-ended envelope 102 having a central ellipsoidal portion and tubular portions extending from each end thereof and housing a filament 104. The filament 104 is electrically and mechanically connected at first ends by first and second lead wires 110, 112, respectively. Tile envelope 102 contains a halogen gas and a fill-gas. The halogen gas in the present invention is a halogen mixed with methyl bromide; however, other gas mixtures are encompassed by the scope of the present invention. The fill gas is preferably selected from the group consisting of xenon, krypton, argon and mixtures of these gases with nitrogen.

The filament 104 extends longitudinally along a major axis of the ellipsoidal portion of the envelope 102. In the preferred embodiment, the filament 104 is a tungsten material and is a coiled-coil type filament, although other filament material and configurations are not outside the scope of the present invention. First and second seals 114, 116 are provided at opposite ends of the envelope 102 in a manner that is well known in the art.

An IR reflective film 118 is provided on the outer surface of the envelope 102. In the preferred embodiment, the IR reflective film 118 is deposited on the envelope 102 by vapor deposition or sputtering; however, the IR film 118 may be deposited on the envelope 102 by other methods. The IR reflective film 118 acts in concert with the ellipsoidal shape of the envelope 102 and the placement of the filament 104 along the major axis A of the ellipsoidal portion of the envelope 102 to perform multiple functions. First, the IR film 118 reflects IR radiation emitted by the lamp towards the filament 104 in order to increase the efficacy of the light source 100. Second, the IR film 118 allows other portions of the radiated spectrum, including visible radiation emitted by the filament 104, to pass through the envelope 102.

It is desired, though not necessary, that the IR film 118 have the optical and temperature properties similar to the filter disclosed in U.S. Pat. No. 4,229,006. The IR film 118 of the exemplary embodiment is a composite or a plurality of stacked layers comprised of alternating high refractive materials and low refractive materials. The IR film has transmittance and reflectance characteristics capable of withstanding and operating effectively at an elevated temperature of, for example 600° Celsius, for a prolonged period of time. The IR film 118 advantageously allows visible radiation to pass through the envelope 102 while reflecting IR radiation towards the filament 104.

In the first embodiment, as shown in FIG. 1, the totally reflecting coating 120 is disposed on both ends of the envelope 102 subtending an angle from approximately twenty two degrees (22°) to approximately forty five degrees (45°) from the major axis A of the ellipsoidal portion of the envelope at each end (i.e., also extending from one hundred thirty five degrees (135°) to approximately one hundred fifty eight degrees (158°) from the major axis). In the second embodiment, illustrated in FIG. 2, the totally reflecting coating 120 is disposed on both ends of the ellipsoidal portion of the envelope 102 subtending an angle from approximately twenty two degrees (22°) to approximately forty five degrees (45°) from the major axis A of the envelope, as well as covering at least a portion of the tubular portions of the envelope. Preferably the portion of each tubular portion surrounding the seal region is not coated. The totally reflecting coating 120 can be made from silver, aluminum or any other desired reflective material exhibiting similar properties.

In developing the invention, it was determined that IR radiation escapes the envelope 102 even when it is covered by the IR reflective coating 118. In particular, the coating is less effective at acute angles measuring less than approximately thirty degrees (30°) from the major axis A of the ellipsoidal portion of the envelope 102 and at obtuse angles measuring approximately one hundred fifty (150°) from the major axis. The totally reflecting coating reflects the IR radiation (as well as the visible radiation) that is escaping at these angles towards the filament. By preferentially reflecting this IR radiation (and also the visible radiation) towards the filament 102 that would otherwise pass through a lamp envelope having only an IR film, the efficacy of the light source 100 is improved. In the first embodiment as shown in FIG. 1 the totally reflecting coating is disposed on both ends of the envelope subtending an angle from approximately twenty two (22°) to approximately forty five degrees (45°) from the major axis (or as measured to the opposite end as an obtuse angle from approximately one hundred thirty five degrees (135°) to one hundred fifty eight degrees (158°)) of the ellipsoidal portion of the envelope 102. In the second embodiment of FIG. 2, the totally reflecting coating 120 is disposed on both ends of the ellipsoidal portion of the envelope (from approximately twenty two degrees (22°) to forty five (45°)), as well as the tubular portions of the envelope. By preferentially reflecting this IR radiation towards the filament 102, the efficacy of the light source 100 is improved.

Figure 3:
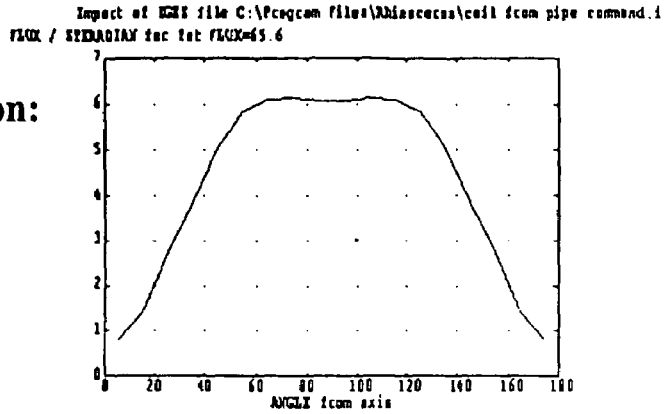
FIGS. 3 and 4 are a graphical representation of the radiation emitted from the lamp in the visible and IR regions, respectively, relative to the angle from the lamp axis.
Figure 4:
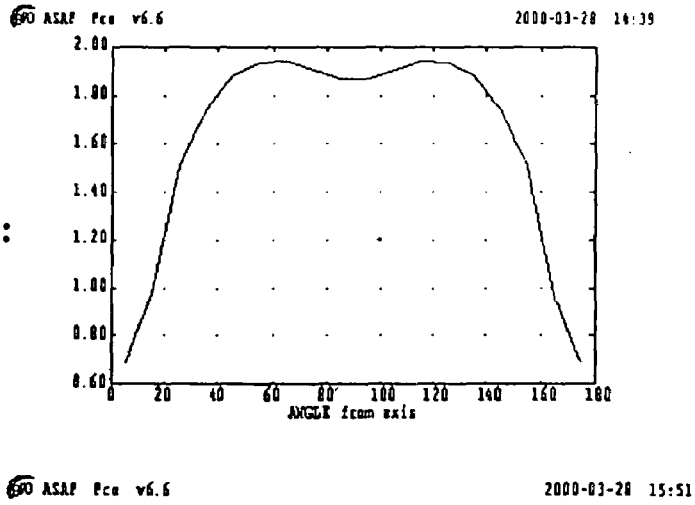

FIGS. 3 and 4 are graphical representations of a modeled angular distribution of output radiation in the visible and IR regions, respectively. As is evident, there are peaks at approximately thirty degrees (30°) and one hundred fifty degrees (150°) for the IR radiation. Thus, by recapturing the IR radiation at the low angles, i.e., zero to thirty degrees (0°–30°) and one hundred fifty to one hundred eighty degrees (150°–180°), through use of the additional reflective end coat, the efficacy is improved. Since it is believed that the IR reflection is based on the angle of incidence, the empirical model was validated qualitatively by subsequent measurement. The visible region, as represented in FIG. 3, starts to reflect at the extreme angles, thus resulting in the graphical representation of FIG. 3.

It is estimated that lamp efficacy may be improved on the order of approximately four percent (4%) by using the totally reflective end coatings on the ends of the envelope. The end coats are relatively inexpensive to add since they involve only a single layer and the technology of coating silver, aluminum, or a similarly functional reflector material is well known.

Although there is consideration that heating of the tubes in the embodiment of FIG. 2 where the reflective coating extends to the tubular portions, and may effect the pinch seal on the molybdenum foil, the benefits offered by improved efficacy will dictate the optimization and the exact placement or extent of the coating.

Figure 5:
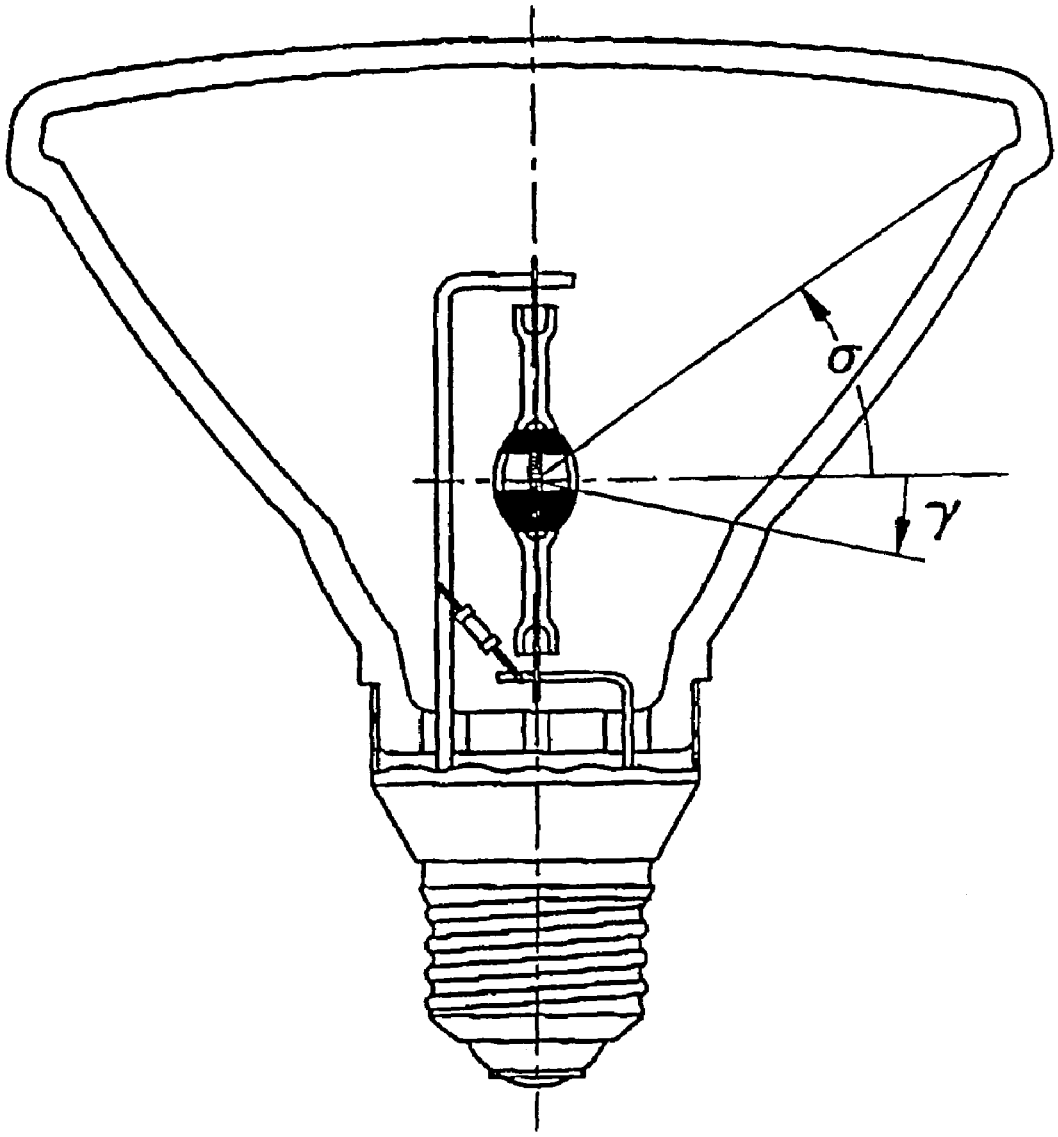
FIG. 5 is an elevational view partially in cross-section of a directional lighting system (PAR 38 reflector) employing features of the present invention.

It will also be appreciated that when the filament is used in a directional lighting system, the system can be optimized by matching the reflective end coat region with the desired reflecting areas of the reflector. Thus, as illustrated in FIG. 5, the useful emitting angles of the filament tubes are sigma ($\sigma$) and gamma ($\gamma$), so that total reflective layers made of aluminum, nichrome, or other material which ensures specular reflection enhances the efficacy of the overall system.

The invention has been described with reference to the preferred embodiments. Obviously modifications and alterations will occur to others upon a reading and understanding of this specification. For example, although a double-ended envelope is illustrated, single-ended lamps where the lead wires extend from the same end of the lamp are also contemplated. The invention is intended to include all such modifications and alteration in so far as they come within the scope of the appended claims or the equivalents thereof.

What is claimed is:

1. A light source comprising:

a lamp envelope made of a light transmissive material, wherein the envelope has an ellipsoidal portion disposed centrally between tubular portions disposed on opposite ends of the ellipsoidal portion;

a filament centrally disposed within the envelope;

an infrared reflective filter coating disposed on at least a portion of the lamp envelope in surrounding relation to the filament, the infrared reflective filter coating having alternate layers of respective high and low refractive indices for selectively passing desired radiation therethrough and reflecting unwanted radiation to the filament;

a totally reflecting coating for eliminating infrared loss at wide angle bulb positions disposed on opposite ends of the envelope in surrounding relation to the filament, the totally reflecting coating subtending an angle of approximately 45° and less measured from an axis aligned with the filament for reflecting radiation that would otherwise pass through the infrared reflective filter coating and increasing the efficiency of the light source during continuous operation.

2. The light source of claim 1 further comprising a pair of lead wires connected to opposite ends of the filament for energizing the filament.

3. The light source of claim 1 further comprising a lead wire connected to an end of the filament and for energizing the filament.

4. The light source of claim 1 wherein the ellipsoidal portion having first and second foci associated therewith; and wherein the length of the filament fits substantially between the first and second optical foci for absorbing substantially all the radiation reflected from the infrared reflective filter and the totally reflecting coating.

5. The light source of claim 1 wherein the totally reflecting coating directs radiation towards the filament.

6. The light source of claim 1 wherein the totally reflecting coating is disposed on portions of both ends of the envelope subtending an angle from approximately 22° from an axis aligned with the filament.

7. The light source of claim 1 wherein the totally reflecting coating is disposed on both ends of the envelope subtending an angle from approximately 22° to 45° from an axis aligned with the filament.

8. The light source of claim 1 wherein the totally reflecting coating is provided on tubular portions extending from opposite ends of the ellipsoidal portion of the envelope.

9. A light source comprising:

a lamp envelope made of a light transmissive material having an ellipsoidal portion;

a filament disposed within the envelope;

an infrared reflective filter coating disposed on at least a portion of the lamp envelope in surrounding relation to the filament, the infrared reflective filter coating having alternate layers of respective high and low refractive indices for selectively passing desired radiation therethrough and reflecting unwanted radiation to the filament;

a totally reflecting coating for eliminating infrared loss at wide angle bulb positions disposed on opposite ends of the envelope in surrounding relation to the filament formed of one of a silver and aluminum coating to direct radiation toward the filament, the totally reflecting coating subtending an angle of approximately 22° to 45° from an axis aligned with the filament for reflecting radiation that would otherwise pass through the infrared reflective filter coating and increasing the efficiency of the light source.

10. The light source of claim 9 wherein the totally reflecting coating is provided on end regions of an ellipsoidal portion of the envelope and tubular portions extending from opposite ends of the ellipsoidal portion.

11. The light source of claim 10 wherein the ellipsoidal portion has first and second foci associated therewith; and wherein the length of the filament is located substantially between the first and second optical foci for absorbing substantially all the radiation reflected from the infrared reflective filter and the totally reflecting coating.

12. The light source of claim 9 wherein the totally reflecting coating directs radiation towards the filament.

13. The light source of claim 9 further comprising a reflector receiving visible light from the light source, the totally reflecting coating matching useful reflecting areas of the reflector.

* * * * *